US006375047B1

(12) United States Patent
Herda et al.

(10) Patent No.: US 6,375,047 B1
(45) Date of Patent: Apr. 23, 2002

(54) CONTAINER FOR STORING PASTY OR FLUIDIC COMPOSITIONS AND APPOINTED DISPENSING OF THE SAME

(75) Inventors: Norbert Herda, Suhl; Albrecht Konietzko, Oberer Stephansberg 49g, DE-96049 Bamberg, both of (DE)

(73) Assignee: Albrecht Konietzko, Bamberg (DE)

( * ) Notice: Subject to any disclaimer, the term of this patent is extended or adjusted under 35 U.S.C. 154(b) by 0 days.

(21) Appl. No.: 09/533,094

(22) Filed: Mar. 23, 2000

(30) Foreign Application Priority Data

Mar. 23, 1999 (DE) ..... 299 05 147

(51) Int. Cl.[7] ..... B65D 83/14

(52) U.S. Cl. ..... 222/389; 222/394; 222/397; 222/262; 222/401; 222/333

(58) Field of Search ..... 222/389, 394, 222/396, 397, 261, 262, 258, 333, 401

(56) References Cited

U.S. PATENT DOCUMENTS 1,296,107 A * 3/1919 Oakley ..... 222/389
2,329,917 A * 9/1943 Lautmann ..... 222/389
3,790,038 A * 2/1974 Kifer ..... 222/389
4,019,654 A 4/1977 Van Manen ..... 222/1
4,632,279 A * 12/1986 Donaldson et al. ..... 222/389
4,972,975 A * 11/1990 Fuhrig ..... 222/333
5,397,178 A 3/1995 Konietzko ..... 366/197
5,816,450 A * 10/1998 Alexander et al. ..... 222/389
5,992,700 A * 11/1999 McGlothlin et al. ..... 222/386.5
6,131,776 A * 10/2000 De Laforcade et al. ..... 222/389

OTHER PUBLICATIONS

Article taken from Deutsche Apotheker Zeitung entitled "Pharma + Partner, 1 Jahr Unguator–Rührsystem", No. 43, pp. 115–117, dated Oct. 26, 1995.

* cited by examiner

*Primary Examiner*—Henry C. Yuen
*Assistant Examiner*—Stephanie L. Willatt
(74) *Attorney, Agent, or Firm*—Cohen, Pontani, Lieberman & Pavane

(57) ABSTRACT

A container for storing pasty or fluidic compositions and apportioned dispensing of the same. The container includes a container body with parallel inner walls; and a movable plunger element, which divides the container body into a compressed-air portion and a storage portion, intended for receiving the pasty or fluidic composition. The plunger can be displaced into the storage portion by introducing compressed air into the compressed-air portion. A compressed-air feed opening is provided, via which compressed air can be blown in from a supply element. A container cover is provided on the body. A dispensing opening is provided in the storage portion, from which the composition emerges, controlled by the amount of compressed air fed in.

2 Claims, 5 Drawing Sheets

CONTAINER FOR STORING PASTY OR FLUIDIC COMPOSITIONS AND APPOINTED DISPENSING OF THE SAME

BACKGROUND OF THE INVENTION

1. Field of the Invention

The present invention concerns a container for storing pasty or fluidic compositions and apportioned dispensing of the same.

2. Discussion of the Prior Art

Relatively small containers are used for the preparation and medium-term storage of, for example, pharmaceutical or cosmetic ointments or similar pasty or fluidic compositions. The contents are often made up to an individual prescription, so that empty containers are required, serving after or even during preparation as a storage container for the special prepared substance. In the medical field, usually cylindrical containers are used, also known as ointment jars, which are closed by a screwed-on container cover. To remove a relatively small amount of the material stored in the container, in the case of most known containers the container cover has to be removed. Especially in fields in which particular hygiene requirements have to be observed, the handling of these containers presents difficulties. The user usually needs both hands to open these known containers, so that to remove the desired amount he has to put down the container cover. Special aids or the fingers are then used for performing the removal. Such handling entails the risk of the composition stored in the container being contaminated. Furthermore, the material to be removed cannot be apportioned sparingly.

U.S. Pat. No. 5,397,178 discloses a stirring system which is designed specifically for the preparation of medicaments. This stirring system uses special ointment jars in which the medicament is prepared and dispensed to the user. The ointment jars shown there have a container body and a container cover with a dispensing opening, which is closed by a closure cap. During preparation, a stirring implement is positioned in the container, the drive shaft being led through the dispensing opening. For subsequent dispensing of the medicament, the interior space of the container can be made smaller by pressing in the bottom plate, so that a corresponding amount of the composition emerges through the dispensing opening. The bottom plate is pressed manually into the container. However, these containers are not particularly suitable for the dispensing of pasty materials, since the specific viscosity of the composition contained means that the force to be exerted for pressing in the bottom plate requires high forces, which cannot be readily applied by most users. Operation is also made more difficult where relatively large containers are concerned.

U.S. Pat. No. 4,019,654 shows a container in which the bottom plate interacts with a threaded rod, axial movement of the bottom plate being induced by turning of the threaded rod. In this case, the threaded rod must be moved in the composition, contained in the container, and be led to the outside through the bottom plate, or be arranged inconveniently outside the container. At the point where it is led through the bottom plate, leakages frequently occur, which may lead to the composition escaping. In the case of relatively large containers, a relatively viscous composition and a small dispensing opening, here too the forces to be exerted may become so great that simple operation is no longer possible or there is the risk of destroying the threaded rod or the counter-thread in the bottom plate.

SUMMARY OF THE INVENTION

The object of the present invention is consequently to provide a container which makes possible simplified and easily apportionable dispensing of pasty or fluidic compositions. The container is at the same time also to satisfy increased requirements for the hygienic storage of the composition.

This object is achieved by a container comprising a container body with parallel inner wall and a plunger element, which is movably inserted into the container body. The plunger divides the container body into a compressed-air portion and a storage portion. The storage portion is separated from the compressed-air portion in an essentially airtight manner and is intended for receiving the pasty or fluidic composition, and can be displaced into the storage portion by introducing compressed air into the compressed-air portion. The container further has a compressed-air feed opening which opens into the compressed-air portion and via which compressed air can be blown in from a supply element. A container cover is also provided and has a dispensing opening, from which the composition emerges, controlled by the amount of compressed air fed in.

The advantage of this invention is, in particular, that squeezing out of the pasty/fluidic composition located in the container is made possible by simple operation with one hand. The force to be exerted is small even in the case of large containers. A further advantage is that leakage points in the bottom of the container are largely avoided, so that both the escape of composition contained is prevented and the contamination of this composition by penetrating dirt particles and bacteria is largely ruled out.

The container according to the invention may be used for the storage and apportioned dispensing of a wide variety of compositions and in different fields of use. In addition to the application in the pharmaceutical, cosmetic or medical field (for example apportioning of ointments and the like), use as a storage container, for example for foods or other consumables of suitable viscosity, is also expedient wherever the medium-term storage and easily apportionable dispensing of pasty/fluidic compositions is needed. By suitable shaping of the dispensing opening, the container can, for example, be used for storing and dispensing mustard, ketchup, soap, greases and other compositions in the various specialist fields.

According to a first embodiment of the invention, the supply element, which provides the compressed air required, is integrated at the lower end of the container into the latter. This may take place for example by lengthening the outer walls of the container body and arranging the supply element in the resulting cavity below the bottom plate. For example, a bellows pump can be arranged in this cavity, the membrane to be activated being directed downward. Such a container may then, for example, be pressed onto a suitable ram, the supply element being activated or the membrane being directly activated. If need be, the container may also be arranged in an external guide, which makes simple one-handed operation possible.

Another embodiment has a pressure cylinder in the lower portion of the container, the axis of the cylinder extending transversely with respect to the longitudinal axis of the container and onto the end of which the compressed-air feed opening opens. Arranged in this cylinder is a displaceable pumping plunger, which can be manually activated, whereby the air contained in the pressure cylinder is pressed through the compressed-air feed opening. In particular in the case of relatively small containers, this arrangement of the pressure cylinder and the pumping plunger makes simple handling possible. The pumping plunger is preferably designed such that, in the retracted position, it is does not protrude beyond the container outer wall, or only slightly, in order to make simple storage of the container possible.

A modified embodiment of the container has by contrast a supply element which is arranged separately from the container and is connected to the compressed-air feed opening via a flexible tube or the like. This comes into consideration in particular for relatively large containers which are not to be moved during the removal of the desired amount of pasty composition. Furthermore, this embodiment offers the advantage that, in the case of containers which are intended for use only once, the associated supply element can be used repeatedly. The last-mentioned advantage can also be achieved in the case of other embodiments by the supply element integrated in the container being releasably connected to the container and able to be separated from the latter if need be, in order for example to be connected to another container. It is consequently conceivable for the supply element to be releasably fastened to the container by means of a bayonet closure or a similar connection.

To be preferred particularly is an embodiment of the container which has a cylindrical form and the inside diameter of which is adapted to a special stirring implement. As a result, the container can be designed, for example, as an ointment jar, which is intended for use on known stirring mechanisms, such as for example according to the above-mentioned U.S. Pat. No. 5,397,178. The dispensing opening is in this case preferably arranged centrally in the container cover and adapted to the shank of the stirring implement.

In the case of a modified embodiment, the plunger element has an additional separating plate. This allows increased requirements existing in some cases with respect to the tightness of the container to be better satisfied.

Another embodiment has sealing lips formed on the plunger element, which provide adequate sealing with respect to the container wall.

It is advantageous if, in a modified embodiment, the compressed-air feed opening opens into a flexible-tube connection piece, which is preferably arranged on the container wall or in the vessel bottom such that it does not protrude beyond the other outer dimensions of the container. On the one hand, the flexible-tube connection piece is consequently protected against damage, on the other hand the avoidance of protrusions leads to simplified packing and transportation of such containers.

In a further embodiment, the compressed-air feed opening is coupled to a valve which prevents the escape of compressed air through the compressed-air feed opening to the outside or back into the supply element. The compressed air introduced via the supply element into the compressed-air portion of the container consequently cannot flow back into the supply element, as a result of which the desired pressure buildup by repeated pumping is possible. In modified variants, the valve may also be arranged in direct association with the supply element.

A particularly advantageous embodiment has a controllable discharge valve in the compressed-air portion of the container, which valve, in the open state, makes a pressure equalization possible between the compressed-air portion and ambient pressure. In the simplest case, this discharge valve is designed as a so-called thumb valve, i.e. a small hole in the compressed-air portion which is closed by the user using a finger when there is the desired buildup of pressure and the release of which allows the compressed air stored in the compressed-air portion to flow out automatically. This allows the compressed-air portion to be depressurized once use of the container has been completed, so that subsequent unwanted escape of the composition contained in the storage portion is no longer possible.

Depending on the application, ball-of-the-thumb pumps, bellows pumps, compressed-air cartridges, motor-operated pumps or the like can be used for example as the supply element.

In a preferred embodiment, the container according to the invention consists of plastic, an injection-molding process being used in manufacture, so that the entire container body can be manufactured in a single operation.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
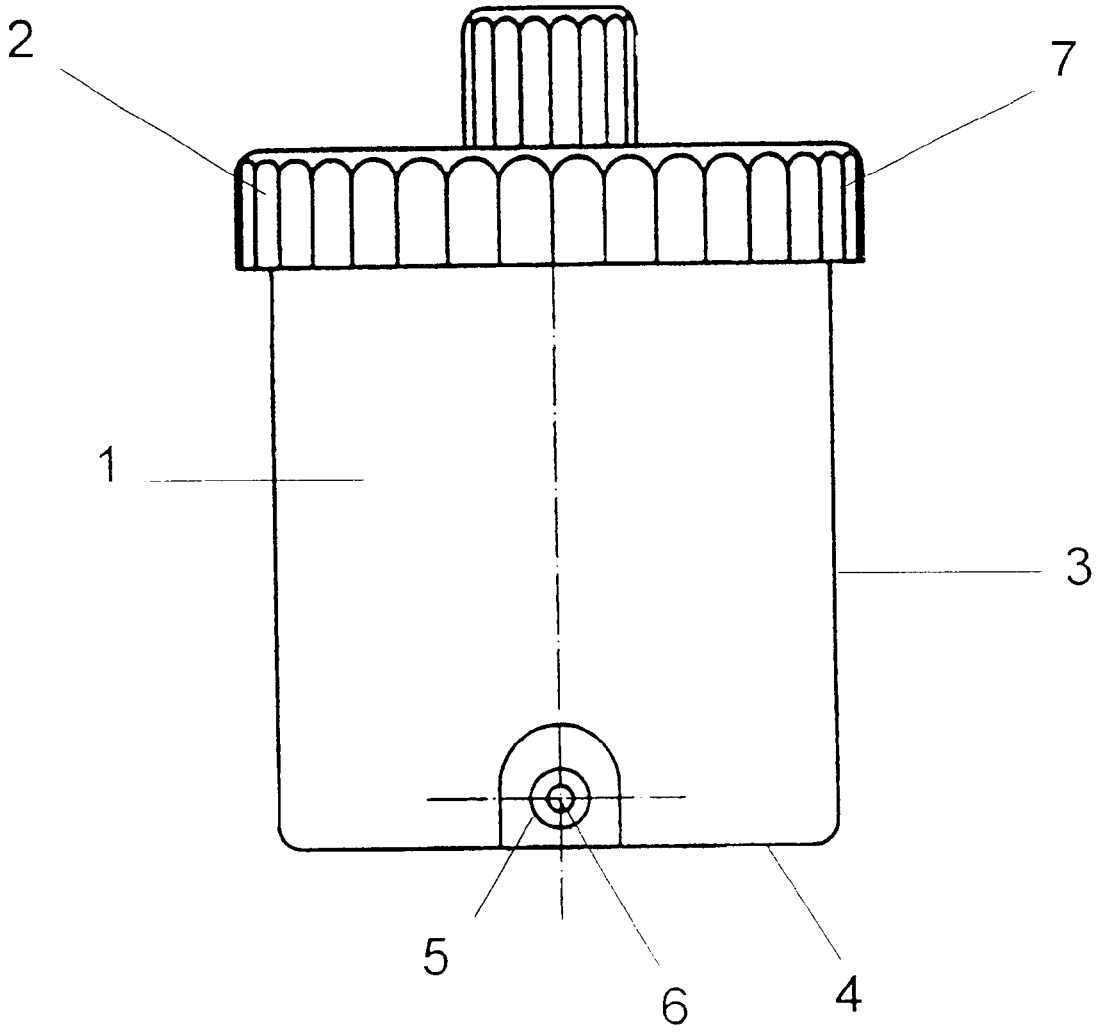
FIG. 1 shows a side view of a first embodiment of the container according to the invention.

FIG. 1 shows the side view of a container according to the invention, in particular for the preparation, storage and dispensing of pasty or fluidic compositions. The embodiment represented concerns a cylindrical container, the outer and/or inner shaping of which may be adapted in other embodiments to the desired purpose. The container comprises a container body 1 and a container cover 2. The walls 3 of the container body 1 extend parallel to one another, and a bottom plate 4, which terminates the container at the bottom, is also provided. In the embodiment represented, a flexible-tube connection piece 5 is arranged in the lower region of the wall 3. Said connection piece has a compressed-air feed opening 6, which opens into the container body 1.

The container body 1 and the container cover 2 are connected to one another in a sealed manner, for example by a threaded connection (not represented in any more detail). In the center, the container cover 2 has a dispensing opening, which is covered by a closure cap 7.

Figure 2:
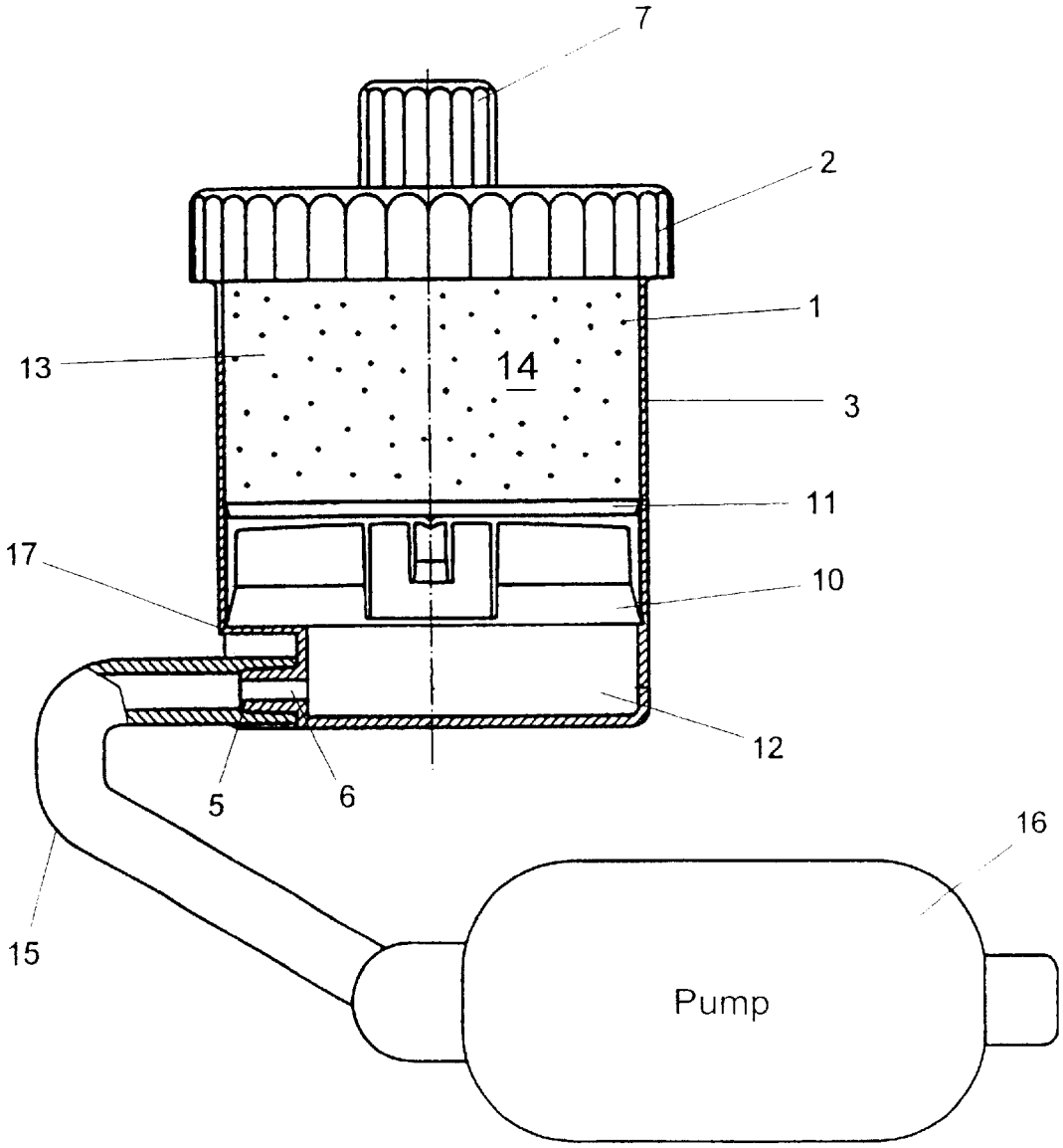
FIG. 2 shows a partly sectioned side view of the embodiment according to FIG. 1, with a supply element.

In FIG. 2, the container is represented in a partly sectioned side view. Provided within the container body 1 in the embodiment shown is a plunger element 10 and a separating plate 11, arranged above it. The plunger element 10 and the separating plate 11 divide the interior space of the container body 1 into a compressed-air portion 12 (lower portion) and a storage portion 13 (upper portion). The compressed-air portion 12 is separated from the storage portion 13 in an essentially airtight manner by the plunger element 10 and the separating plate 11. The compressed-air feed opening 6 of the flexible-tube connection piece 5 opens into the compressed-air portion 12. A pasty or fluidic composition 14 is contained in the storage portion 13. The flexible-tube connection piece 5 is connected in this embodiment via a flexible tube 15 to a supply element 16 (i.e., pump). The flexible-tube connection piece 5 is positioned on an inwardly offset portion of the wall 3, so that when the flexible tube 15 is pulled off the connection piece 5 does not protrude beyond the other wall portions of the container body 1. The offset in the wall also provides a stop 17 for the plunger element 10, which prevents the plunger element 10 from penetrating too far into the compressed-air portion 12 when the storage portion 13 is filled with the composition 14. The stop 17 may also be designed in any other desired way. The supply element 16 provides the compressed air required and may be any desired pump, a compressed-air cartridge or the like. If motor-operated pumps or compressed-air cartridges are used, suitable control means, in particular valves, which make good apportioning of the air supply possible, are to be provided.

When compressed air is introduced into the compressed-air portion 12 of the container body 1 from the supply element 16 via the flexible tube 15 and the compressed-air feed opening 6, an increased pressure builds up in the compressed-air portion 12. As a result, when there is adequately high pressure, the plunger element 10, and consequently the separating plate 11, have the tendency to give way in the direction of the container cover 2. As soon as the closure cap 7 has been removed, the plunger element 10 and separating plate 11 move into the storage portion 13, so that the composition 14 will emerge from the dispensing opening in the desired amount. As soon as no further compressed air is being fed in, no further composition is dispensed and the closure cap 7 can be fitted again onto the dispensing opening.

In a modified embodiment, a discharge valve, which makes it possible for the compressed air to be discharged from the compressed-air portion 12 without removal of the flexible tube 15, may also be provided (see below).

Similarly, in other embodiments, a safety valve, via which excessive pressure can escape when the discharge opening is closed, may be arranged in the container cover or in the container body.

Figure 3:
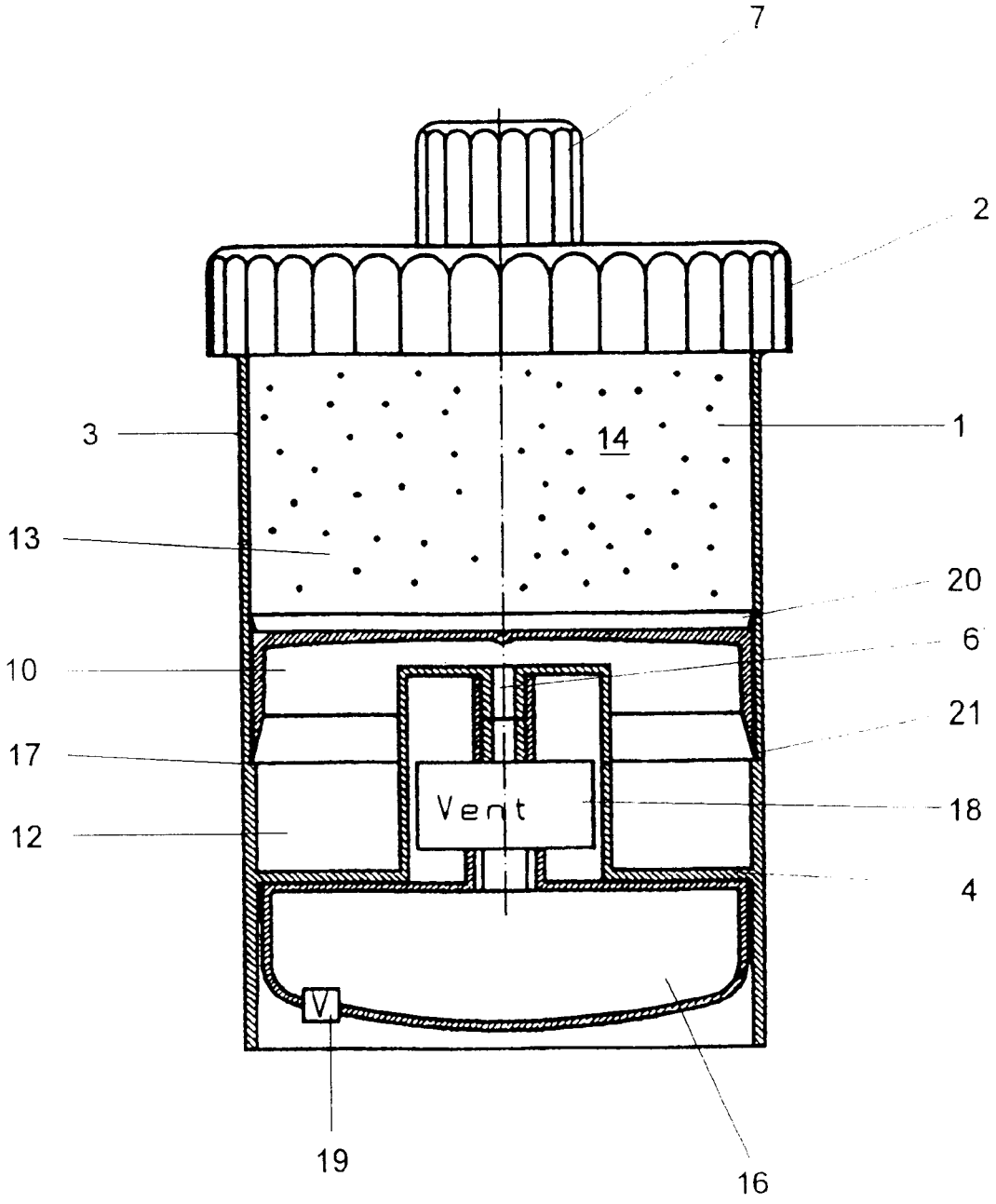
FIG. 3 shows a partly sectioned side view of a second embodiment of the container.

FIG. 3 shows the partly sectioned side view of a modified embodiment of the container according to the invention. The main difference with respect to the embodiment previously described is that the supply element 16' is not separately arranged, but is integrated into the container body 1. Here, the wall 3 of the container body protrudes downward beyond the bottom plate 4, so that a cavity surrounded by the wall 3 is produced, in which the supply element 16' can then be firmly connected to the container body or inserted as an independent component into this cavity. The latter alternative makes it possible for the supply element 16' to be re-used for similar containers once the container has been emptied. Again there is the compressed-air feed opening 6', via which the compressed air can be blown into the compressed-air portion 12. The compressed-air feed opening is also combined with an outlet valve 18, which prevents the return flow of the compressed air into the supply element 16'. The supply element 16' additionally has an inlet valve 19, in order to receive air from the atmosphere. For sealing off between the container wall 3 and the plunger element 10, in this embodiment an upper sealing lip 20 is arranged on the plunger element 10. Also provided in the lower region of the plunger element is a lower sealing lip 21. The stop 17 is formed here by an edge in the wall 3.

Figure 4:
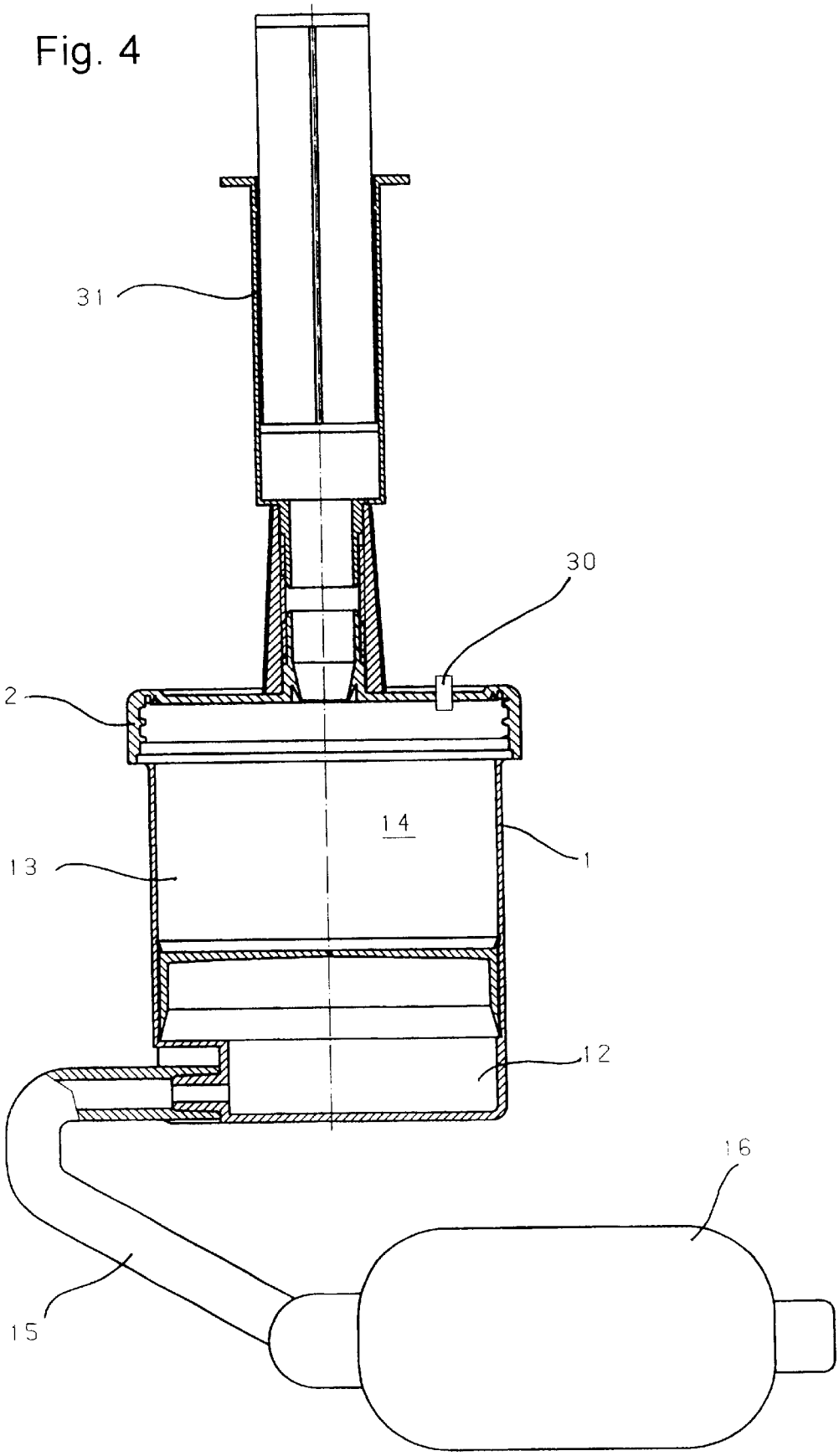
FIG. 4 shows a partly sectioned side view of the embodiment according to FIG. 2, with a syringe connected to the container cover.

FIG. 4 shows in a partly sectioned side view a development of the invention which has already been explained in conjunction with FIG. 2. The container body 1 is again filled with pasty/fluidic composition 14. Compressed air is pumped into the compressed-air portion 12 from the supply element 16 via the flexible tube 15. The container body 1 is closed by the container cover 2. Integrated in the container cover 2 is a pressure-relief valve 30, via which excess air located in the storage portion 13 can escape if need be. The pressure-relief valve 30 is preferably designed in such a way that, although it allows excess air to escape into the atmosphere, it is closed when the composition 14 advances, in order that the latter does not escape from the storage portion 13 in an uncontrolled way. In other embodiments, the pressure-relief valve 30 may also be integrated directly in the container body 1.

In the embodiment shown in FIG. 4, the dispensing opening is formed in the container cover 2 for receiving a syringe 31. The syringe 31 (or some other application aid) can then be filled with the composition 14 extremely hygienically and if need be with only one hand, by compressed air being introduced into the compressed-air portion 12. As this happens, the composition 14 emerges from the storage portion 13 and passes directly into the cylinder of the syringe 31.

Figure 5:
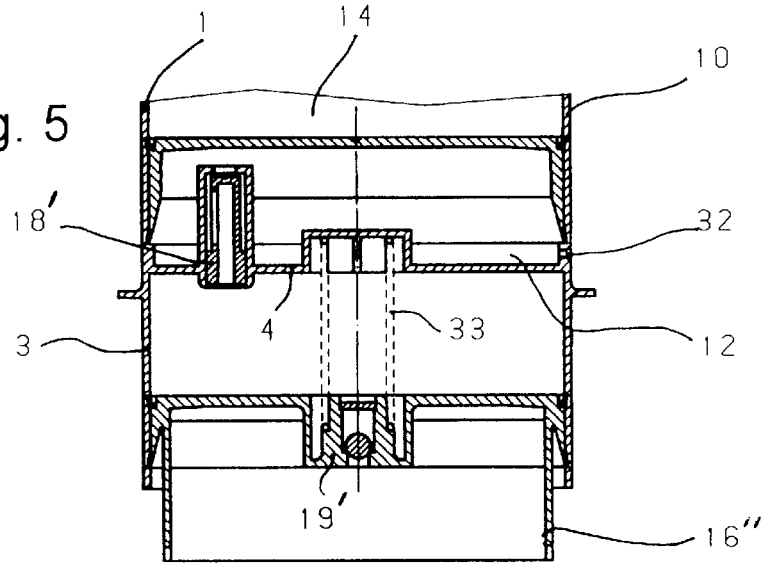
FIG. 5 shows a sectional view of the lower region of a third embodiment of the container.

FIG. 5 shows a modified embodiment in a lateral sectional view, only the lower region of the container body 1 being represented. In this case, again an outlet valve 18' is integrated into the bottom plate 4, in order to build up the desired pressure in the compressed-air portion 12 in a number of stages. A plunger, which slides in the downwardly lengthened container wall, serves as the supply element 16". In the moved-out position, the plunger 16" protrudes beyond the wall 3, so that the plunger movement can be induced by placing the plunger onto an underlying surface and vertical displacement of the entire container body downward. In the example represented, the inlet valve 19', which may be for example a ball valve or some other suitable valve, is integrated in the plunger. A controllable discharge valve 32 is also provided in the region of the compressed-air portion 12. This discharge valve 32 serves the purpose if need be of equalizing the built-up pressure in the compressed-air portion 12 to the ambient pressure. In the simplest case represented, the discharge valve 32 is a small opening which functions as a thumb valve. As long as the user closes the thumb valve by pressing the thumb or a finger onto it, an increased pressure can be built up in the compressed-air portion 12. As soon as the user takes his hand away from the container, the thumb valve is opened and the pressure equalization takes place. This ensures that the container is never under increased pressure when not in use, and consequently the composition 14 cannot escape in an unwanted way. In order to return the supply element 16 into the starting position after activation, a spring 33, which is mounted at its upper end in the bottom plate 4, is provided.

Figure 6:
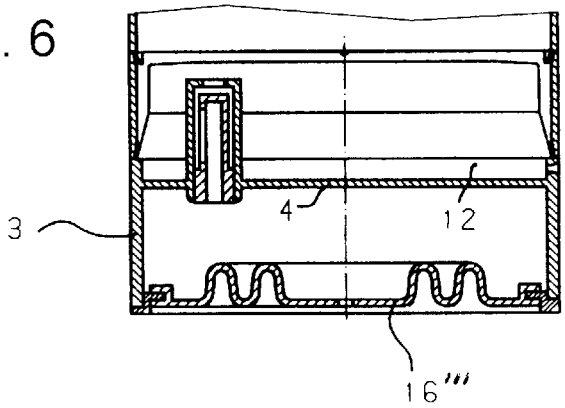
FIG. 6 shows a sectional view of the lower region of a fourth embodiment of the container.

FIG. 6 shows in a sectioned side view a further modified embodiment, again only the lower region of the container being represented. Here, the supply element 16'" is formed by a bellows membrane, which is fastened, for example by ultrasonic welding, peripherally to the wall 3 protruding downward beyond the bottom plate 4. The desired pressure in the compressed-air portion 12 is built up by repeated manual activation of the bellows membrane.

Figure 7:
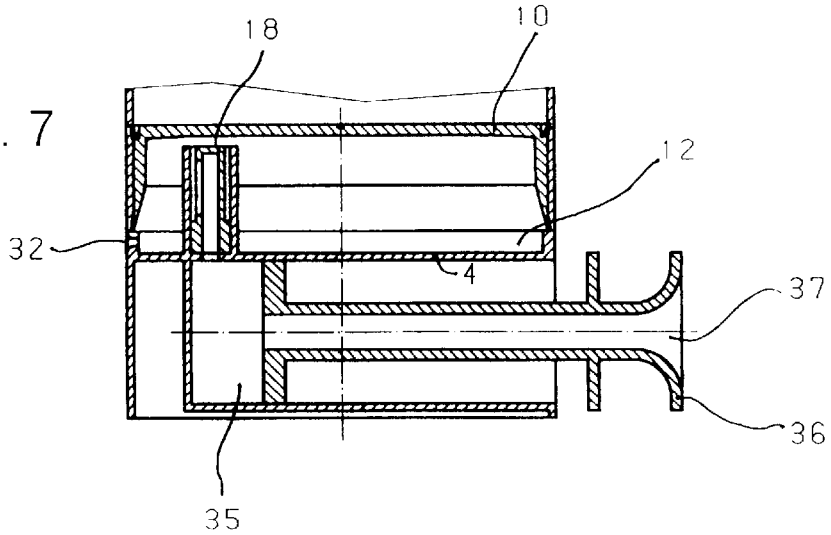
FIG. 7 shows a sectional view of the lower region of a fifth embodiment of the container, with an integrated pressure cylinder and a pumping plunger for the buildup of pressure.

Another embodiment is shown in FIG. 7, in a sectioned side view. As in the previous cases, here too only the lower region of the container is represented. In this case, the supply element comprises a pressure cylinder 35 and a pumping plunger 36, running in the pressure cylinder 35. The outlet valve 18 opens into the rear region of the pressure cylinder 35. By activation of the pumping plunger 36, air is pumped from the pressure cylinder 35 via the outlet valve 18 into the compressed-air portion 12. In the embodiment shown, the pumping plunger 36 is provided with a through-bore 37, which opens out in the grip portion of the pumping plunger 36. This again provides a kind of thumb valve, which can be closed by the user's thumb during the pumping operation. If the user wishes to push the pumping plunger 36 into the pressure cylinder 35 merely for storing it better, without building up pressure in the compressed-air portion 12, the through-bore 37 remains opened during the plunger movement. The discharge valve 32 (for example a thumb valve) can again be provided in the side wall of the compressed-air portion 12.

There are a variety of conceivable modifications, differing with regard to the arrangement of the compressed-air feed opening and/or the supply element. A very wide variety of supply elements can also be used for producing the compressed air required. Without changing anything about the invention with regard to its functionality, that is compressed-air-controlled apportioning from a container, any horizontal container cross section is conceivable, such as oval or polygonal. It may also be expedient to provide the removal opening with a safety valve, for better apportioning of the amount discharged. This safety valve can also be manually activated, so that it facilitates the venting of the container and at the same time prevents overpressure in the storage portion leading to uncontrolled escape of the material when the dispensing opening of the container is opened.

We claim:

1. A container for storing and apportioned dispensing of pasty and fluidic compositions, comprising:

a container body having parallel inner walls;

a plunger element moveably arranged in the container body so as to divide the container body into a compressed-air portion and a storage portion which is separated from said compressed-air portion in an essentially air tight manner and is intended for receiving the pasty or fluidic composition, the plunger element being displaceable into the storage portion by introducing compressed air into the compressed-air portion;

means for supplying compressed air to the compressed-air portion, the supply means being integrated into the container body at a lower end of the container body;

a compressed-air feed opening which opens into the compressed-air portion and via which compressed air can be blown in from the supply means;

a container cover mounted on the body; and a dispensing opening in the storage portion from which the composition emerges, controlled by an amount of compressed air fed into the compressed-air portion, the supply means including a pressure cylinder integrated in the container body so that an axis of the cylinder extends transversely with respect to a longitudinal axis of the container, the compressed-air feed opening being arranged to open onto an end of the cylinder, a displacable pumping plunger being arranged in the pressure cylinder so that air contained in the pressure cylinder can be pressed through the compressed-air feed opening.

2. A container for storing and apportioned dispensing of pasty and fluidic compositions, comprising:

a container body having parallel inner walls;

a plunger element moveably arranged in the container body so as to divide the container body into a compressed-air portion and a storage portion which is separated from said compressed-air portion in an essentially air tight manner and is intended for receiving the pasty or fluidic composition, the plunger element being displacable into the storage portion by introducing compressed air into the compressed-air portion;

means for supplying compressed air to the compressed-air portion, the supply means being arranged separately from the container body;

a compressed-air feed opening, which opens into the compressed air portion and via which compressed air can be blown in from the supply means;

a container cover mounted on the body;

a dispensing opening in the storage portion from which the composition emerges, controlled by an amount of compressed air fed into the compressed-air portion; and a flexible tube arranged to connect the compressed-air feed opening to the supply means, the compressed-air feed opening into a flexible-connecting piece which is arranged on a bottom portion of the wall of the container body that is offset inwardly so that the flexible-tube connection piece does not protrude beyond outer dimensions of the container body.

* * * * *